US006095063A

United States Patent [19]

Lee et al.

[11] Patent Number: 6,095,063

[45] Date of Patent: Aug. 1, 2000

[54] EXHAUST TREATMENT MACHINE

[75] Inventors: Ju-Long Lee, Keelung; Hunter Chung, Hsinchu, both of Taiwan

[73] Assignees: UTEK Semiconductor Corp.; United Microelectronics Corp., both of Hsinchu, Taiwan

[21] Appl. No.: 09/383,649

[22] Filed: Aug. 26, 1999

[51] Int. Cl.[7] ..... F23J 15/00; F23J 11/00

[52] U.S. Cl. ..... 110/215; 110/203; 110/345; 110/165 R

[58] Field of Search ..... 110/203, 215, 110/216, 342, 345, 165 A, 165 R, 167, 171

[56] References Cited

U.S. PATENT DOCUMENTS 2,725,834 12/1955 Richter-Glier ..... 110/171

4,738,687 4/1988 Smieskol et al. ..... 48/197 R 5,878,675 3/1999 Iijima et al. ..... 110/215

*Primary Examiner*—Denise L. Ferensic

*Assistant Examiner*—Ken B. Rinehart

*Attorney, Agent, or Firm*—J.C. Patents; Jiawei Huang

[57] ABSTRACT

An exhaust treatment machine. The exhaust treatment machine has a burning chamber and a wet chamber. Water is injected into the wet chamber by a water inlet at a bottom portion of the wet chamber. At least two rotor blades are installed over the bottom of the wet chamber to generate a vortex flow of the water. Thus, the vortex flow of the water acentrically flushes away the product produced in the burning chamber and removes it via a drainpipe. Furthermore, those clots agglomerated from the powers produced in the burning chamber are fragmented by the rotor blades. The problems of blocking the drainpipe is thus resolved.

9 Claims, 2 Drawing Sheets

EXHAUST TREATMENT MACHINE

BACKGROUND OF THE INVENTION

1. Field of the Invention

The present invention relates to an exhaust treatment machine, and more particularly to an exhaust treatment machine using a powder destruction mechanism.

2. Description of the Related Art

An exhaust produced in a reaction chamber of a processing machine is first delivered to an exhaust treatment machine which contains a certain quantity of water. FIG. 1 shows an exhaust treatment machine 10 according to the prior art. The exhaust treatment machine 10 comprises a burning chamber 28 and a wet chamber 20 filled with water. When an exhaust 30 produced in a reaction chamber (150) is delivered to the exhaust treatment machine 10, a low toxic or nontoxic powder and gas are produced in the burning chamber 28 through a burning reaction. Powder 18 readily accumulates on an inner wall of the burning chamber 28, and a water jet device 22 is installed in the wet chamber 20 to remove the powder 18 via a drainpipe 24. However, the exhaust treatment machine 10 is in a high temperature condition during the process; thus, the powder 18 is agglomerated into clots 26. When the water jet device 22 removes the clots 26 on the inner wall of the burning chamber 28, the clots 26 can block the drainpipe 24 and prevent water from being discharged from the wet chamber 20; thus, the water level of the wet chamber rises. Consequently, the exhaust treatment machine may break down and the processing machine shuts down, which seriously affects yield.

In the above situation, one general solution is first to cool down the exhaust treatment machine 10 to a room temperature, and then to open the wet chamber 20 for repairs. However, this is a time-consuming resolving method and it further reduces the uptime for operation of a fabrication process system. Another solution is to open a view port window of the wet chamber 20 while the temperature is still high to remove the clots 26. However, only a local clean-up is possible and the technician performing this task has a high risk of being burned or inhaling toxic gas.

SUMMARY OF THE INVENTION

The invention provides an exhaust treatment machine to prevent powder in a wet chamber from being agglomerated into clots and to prevent a drainpipe from being blocked by the clots. Furthermore, the invention provides an exhaust treatment machine that breaks down less frequently and thus increases the operating time for an exhaust treatment machine and a processing machine.

The invention provides an exhaust treatment machine comprising a burning chamber and a wet chamber under the burning chamber. An annulus partition is installed between the burning chamber and the wet chamber. In this manner, a product of a burning reaction in the burning chamber is collected in the wet chamber. The wet chamber contains water supplied from a water inlet through a chamber wall at a bottom portion of the wet chamber. A propeller is installed over a bottom surface of the wet chamber. The propeller rotates and is driven by a driving means to generate a vortex flow. The burning product is drawn by the vortex flow to be fragmentized by at least one rotor blade of the propeller. A drainpipe is further disposed along a tangential direction of the vortex flow to discharge the fragmentized product carried by the vortex flow.

According to one preferred embodiment of the invention, the driving means includes a motor driver, and the rotor blade can have a uniform thickness or can be a razor-shaped.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

An exhaust produced from a reaction chamber in a fabrication process system is first delivered to an exhaust treatment machine, followed by a further treatment. In the invention, a modification is made to the exhaust treatment machine to enhance the operation efficiency thereof.

Figure 1:
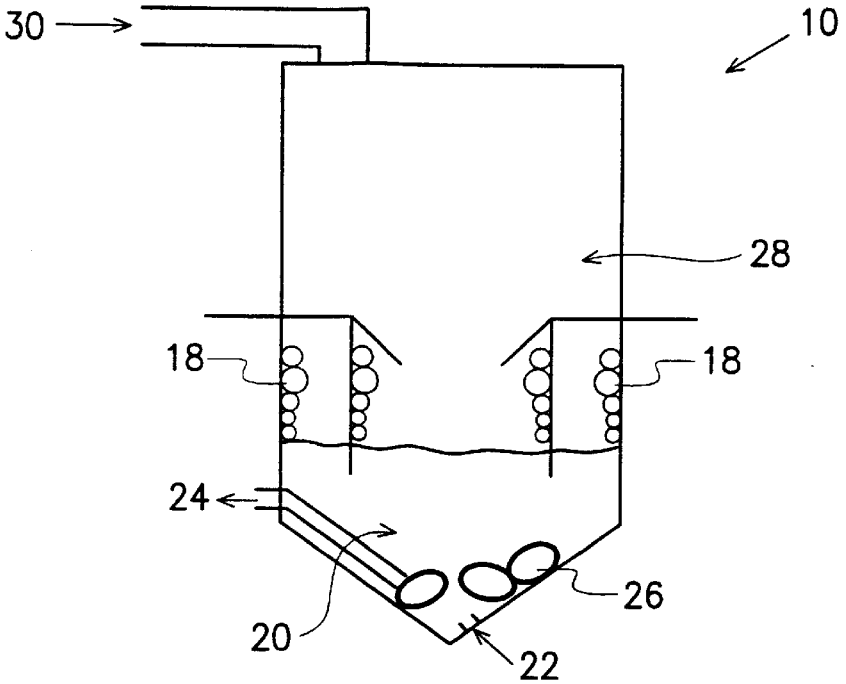
FIG. 1 (PRIOR ART)
FIG. 1 shows an exhaust treatment machine according to the prior art.
Figure 2:
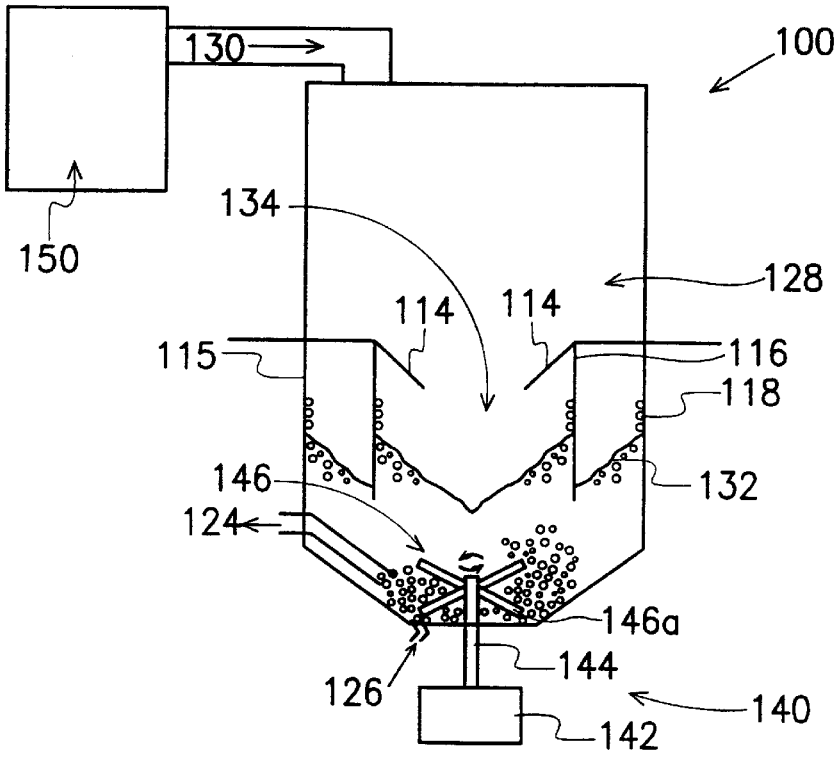
FIG. 2 shows an exhaust treatment machine having a powder destruction mechanism according to one preferred embodiment of the invention.

FIG. 2 shows an exhaust treatment machine having a powder destruction mechanism according to one preferred embodiment of the invention.

An exhaust treatment machine 100 comprises a burning chamber 128 and a wet chamber 134. When an exhaust 130 produced by a reaction chamber (150) is delivered to the exhaust treatment machine 100, a low- toxic or nontoxic powder and a gas is produced in the burning chamber 128 by a burning reaction. The powder product is drawn by an air stream to the wet chamber 134 through a funnel-shaped partition 114 between the burning chamber 128 and the wet chamber 134, while the gas product is dissolved in a solvent such as water contained in the wet chamber 134.

A vertical partition 116 is located underneath the funnel-shaped partition 114; thus, an annulus channel is formed between the vertical partition 116 and an inner wall 115 of the wet chamber 134. A porous partition and a spray device (both not shown) are further installed in the ring-shaped tunnel to increase the dissolved amount of the gas product.

A powder removal mechanism is employed over an inner bottom surface of the wet chamber 134. The powder destruction mechanism comprises a propeller which further comprises at least two rotor blades 146*a*, a rotor shaft 144 and a driving means 142. The rotor blades 146*a* is attached onto one end of the rotor shaft 144, while the rotor shaft 144 has the other end connected and driven by the driving means 142. The driving means 142 is, for example, a motor driver. In addition, there is a water inlet 126 at a bottom portion of the wet chamber 134 and a drainpipe 124. The drainpipe 124 is located along a tangential direction of a vortex flow induced by rotation of the propeller 146. Therefore, driven by a centrifugal force, the water is discharged out of he wet chamber 134 through the drainpipe 124.

Figure 3:
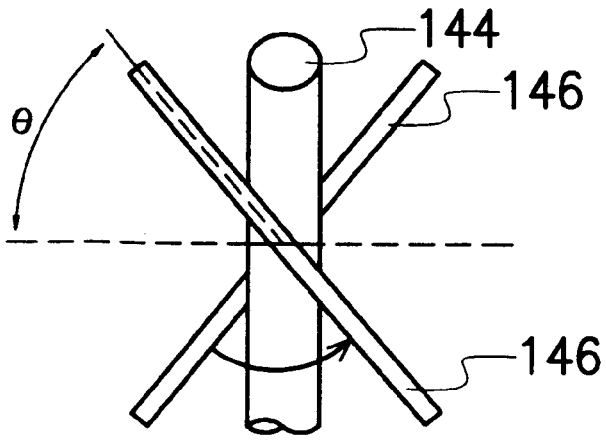
FIG. 3 is a schematic, cross-sectional view showing a rotor blade having a uniform thickness.
Figure 4:
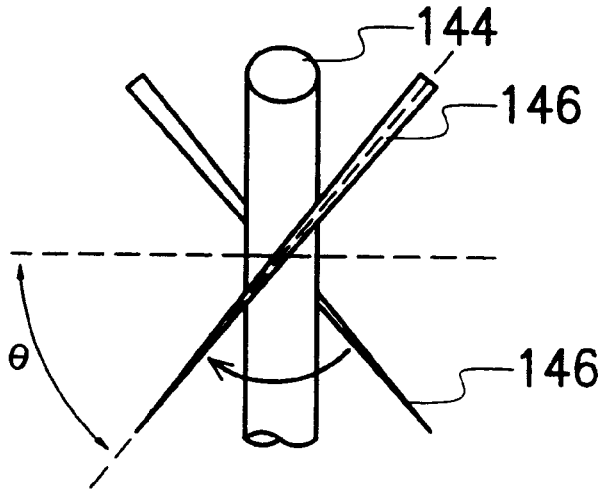
FIG. 4 is a schematic, cross-sectional view showing a razor-shaped rotor blade having a cutting function.

Preferably, the propeller 146 comprises an even number of rotor blades, for example, four rotor blades 146a as shown in FIG. 2. FIG. 3 and FIG. 4 shows an exploded view of one rotor blade 146*a*. The rotor blade 146*a* is canted from a horizontal plane with a tilt angle θ in order to induce a vortex flow by rotation. The direction which the rotor blade 146*a* is canted depends on the rotation direction of the rotor shaft 144. FIG. 3 and FIG. 4 are schematic, cross-sectional views from the tip of the rotor blade 146 toward the center of the rotor shaft 144 along the radial axis. When the rotation of the rotor shaft 144 is counter-clockwise, the rotor blade 146 tilts to the right side as shown in FIG. 3 and FIG. 4. Thus, if the rotation of the rotor shaft 144 is clockwise, then the rotor blade 146 tilts to the left side.

The rotor blade 146 can have a uniform thickness, as shown in FIG. 3, and can be razor-shaped to promote a cutting function, as shown in FIG. 4.

The powder drawn into the wet chamber 134 through the funnel-shaped partition 114 readily accumulates on the vertical partition 116 and the inner wall 115 of the wet chamber 134. The powder that accumulates on the vertical partition 116 and the inner wall 115 of the wet chamber 134 readily agglomerates into clots at a high temperature. After water is injected into the wet chamber 134 via the water inlet 126, a vortex flow of the water is induced by the rotation of the propeller 146. An acentric flush effect occurs due to the centrifugal force induced by the vortex flow. The powder accumulated or clots agglomerated on the inner wall 115 of the wet chamber 134 and on the inner side of the vertical partition 116 are thus drawn into the water. Once drawn by the vortex flow and hitting the propeller 146, the accumulated powder or the agglomerated clots are fragmented by the rotor blades 146*a*, followed by being drained way from the wet chamber 134 via the drainpipe 124.

The exhaust treatment machine provided according to the invention prevents the powder from accumulating on the inner wall 115 and the vertical partition 116; thus, the ventilated path can keep clear and the exhaust treatment machine can properly work. Furthermore, preventive maintenance periods can be extended.

The powder destruction mechanism of the exhaust treatment machine can be operate continuously or only start when required, for example, when the water level has exceeded the security line.

The invention has advantages as follows.

1. The exhaust treatment machine fragments big clots, formed by accumulating powder on the wet chamber, to prevent the big clots from blocking the drainpipe.

2. The water level does not exceed the security line in the exhaust treatment machine; thus, the possibility of the exhaust treatment machine breaking down is reduced and the operating time for the exhaust treatment machine and the processing machine is increased.

Other embodiments of the invention will appear to those skilled in the art from consideration of the specification and practice of the invention disclosed herein. It is intended that the specification and examples be considered as exemplary only, with a true scope and spirit of the invention being indicated by the following claims.

What is claimed is:

1. An exhaust treatment machine comprising:

a burning chamber;

a wet chamber, located under the burning chamber;

a water inlet, located at a bottom portion of the wet chamber to inject water into the wet chamber;

a propeller, located over a bottom of the wet chamber; and a drainpipe, penetrating through a wall of the wet chamber.

2. The exhaust treatment machine according to claim 1, comprising further a funnel-shape partition between the burning chamber and the wet chamber.

3. The exhaust treatment machine according to claim 1, wherein the propeller further comprises:

at least two rotor blades to generate a vortex flow of the water;

a rotor shaft, with one end coupled to the rotor blades; and a driving means to drive the rotor shaft coupled with the other end of the rotor shaft.

4. The exhaust treatment machine according to claim 3, wherein the rotor blades have a uniform thickness.

5. The exhaust treatment machine according to claim 3, wherein the rotor blades are razor-shaped.

6. An exhaust treatment machine comprising:

a burning chamber, the burning chamber is located above a funnel-shaped partition;

a wet chamber, the wet chamber is located under a funnel-shaped partition;

a water inlet, at a bottom of the wet chamber to provide water to the wet chamber;

at least two rotor blades, installed over the bottom of the wet chamber to generate a vortex flow of the water; and a drainpipe, installed along a tangential direction of the vortex flow of the water on a wall of the wet chamber.

7. The exhaust treatment machine according to claim 6, wherein the rotor blades are rotated by a driving motor.

8. The exhaust treatment machine according to claim 6, wherein the rotor blades have a uniform thickness.

9. The exhaust treatment machine according to claim 6, wherein the rotor blades are razor-shaped.

* * * * *